US005111877A

United States Patent [19]

Buchanan et al.

[11] Patent Number: 5,111,877

[45] Date of Patent: May 12, 1992

[54] MULTI-TUBE HEAT EXCHANGER WITH MECHANICALLY INTERLOCKED TUBES FORMED FROM MECHANICALLY INTERLOCKED PLATES

[75] Inventors: William J. Buchanan, Olcott; Siegfried A. Wasse, Grand Island, both of N.Y.

[73] Assignee: General Motors Corporation, Detroit, Mich.

[21] Appl. No.: 724,015

[22] Filed: Jul. 1, 1991

[51] Int. Cl.[5] ..... F28D 1/03

[52] U.S. Cl. ..... 165/153; 165/152; 165/176

[58] Field of Search ..... 165/152, 153, 176

[56] References Cited

U.S. PATENT DOCUMENTS 4,723,601 1/1988 Ohara et al. ..... 165/153
4,800,954 1/1989 Noguchi et al. ..... 165/153

FOREIGN PATENT DOCUMENTS 52-248991 10/1987 Japan ..... 165/153
63-14083 1/1988 Japan ..... 165/153

*Primary Examiner*—Allen J. Flanigan
*Attorney, Agent, or Firm*—Ronald L. Phillips

[57] ABSTRACT

A multi tube heat exchanger core in which each tube is made from a pair of substantially identical thin sheet metal plates interfitted in a face to face relationship. Each plate has a pair of enlarged protuberances projecting side by side from the upper side surfaces thereof to form tank portions which are adapted to receive the heat exchanger fluid after the plates are built up into a core. The paired plates forming the tubes are mechanically and accurately aligned at their lower side ends by interfitting locking arms and arm receiving slots. To precisely space the tubes from one another so that air centers can be readily installed therebetween, the lower ends of the plates are formed with tube spacing flanges bent perpendicular to the plane of the plate that interlock with one another by tabs and notches. The tabs are formed with protrusions that extend the lower contact walls of the tabs downwardly to effectively increase tab width so that some portion of the tabs engage the corresponding contact wall of the associated notch to ensure contact between the tabs and their notches and thereby providing the predetermined spacing of the tubes from one another and their support to reduce crushing of the air centers during clamping and while being brazed in an oven. With this construction, allowance for normal dimensional variation in plate to plate stacking is provided. This construction also partially seals the lower end of the heat exchanger to optimize heat exchanger construction and efficiency.

4 Claims, 2 Drawing Sheets

MULTI-TUBE HEAT EXCHANGER WITH MECHANICALLY INTERLOCKED TUBES FORMED FROM MECHANICALLY INTERLOCKED PLATES

FIELD OF THE INVENTION

This invention relates to heat exchangers, and more particularly to tube construction for a heat exchanger core with each tube formed from pairs of substantially identical plates having mating locking arm and arm slot construction at their lower end that mechanically align a pair of plates to one another to form a tube and having mating tabs and notches which also space and mechanically align adjacent tubes to one another so that a heat exchanger core can be mechanically built with air centers therebetween to facilitate subsequent handling and effectively resist crush load from clamping and brazing in an oven. In this invention, some of the tabs have special protrusions which are offset to increase tab width to accommodate production variations in plate sizes.

SUMMARY

This invention provides an economical and highly efficient heat exchanger core by employing special stamped core plates which interlock with one another in precisioned alignment to form discrete tubes of a heat exchanger core. The core plate construction further rigidly connects and spaces these tubes to one another so that air centers can be inserted therebetween. More particularly, the plates are identical and are mechanically interconnected at their lower side ends by cooperating locking arms and slots to form the tubes. Special tabs and notches on the plates mechanically space and interconnect the tubes to one another so that air centers can be inserted therebetween. This construction provides column support to allow a heat exchanger core to be mechanically assembled with accurate alignment of the core tubes which facilitates subsequent handling and supports loads when the aligned core is subsequently clamped and brazed in an oven whose temperature is carefully controlled so that the core is brazed together without destruction of the relatively fragile air centers as well as other components of the core.

In a preferred embodiment of this invention, the separate plates are paired, aligned and mechanically locked together to form each tube by laterally extending interlocking arms and arm receiving slots formed in a lower centralized portion of the plates to mechanically secure adjacent plates together to form tubes. The plates further have separate lower tabs which extend in direction opposite to the locking arm to fit into the tab notches of a plate of an adjacent tube to accurately align and operatively connect separate tubes to one another. Importantly, the tabs have downwardly projecting offsets or protrusions which have an "eyebrow" configuration to effectively increase the tab width so that a wider range of variations in plate sizes can be employed in the production of a high quality core. Furthermore, the present invention optimizes the use of plate material, and the plate is easier to make and is lighter in weight than other proposed designs The lower locking arms and flanges provide an effective closure of the bottom of the core to retain the air centers and reduce air leakage from the lower end of the core.

DESCRIPTION OF THE PREFERRED EMBODIMENTS

Figure 1:
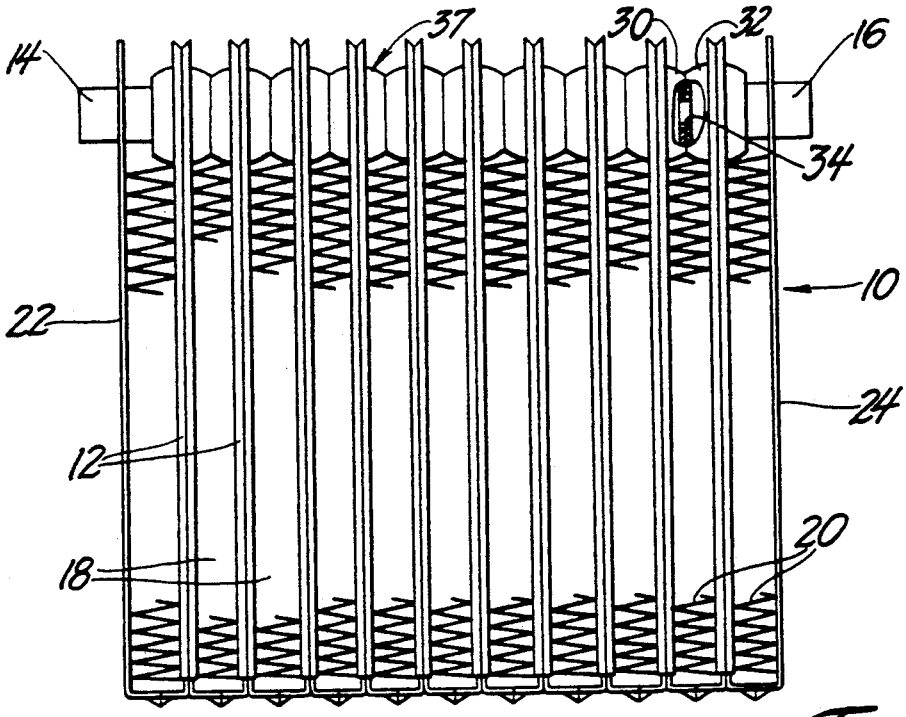
FIG. 1 is an front elevation view of a heat exchanger with parts broken away.
Figure 2:
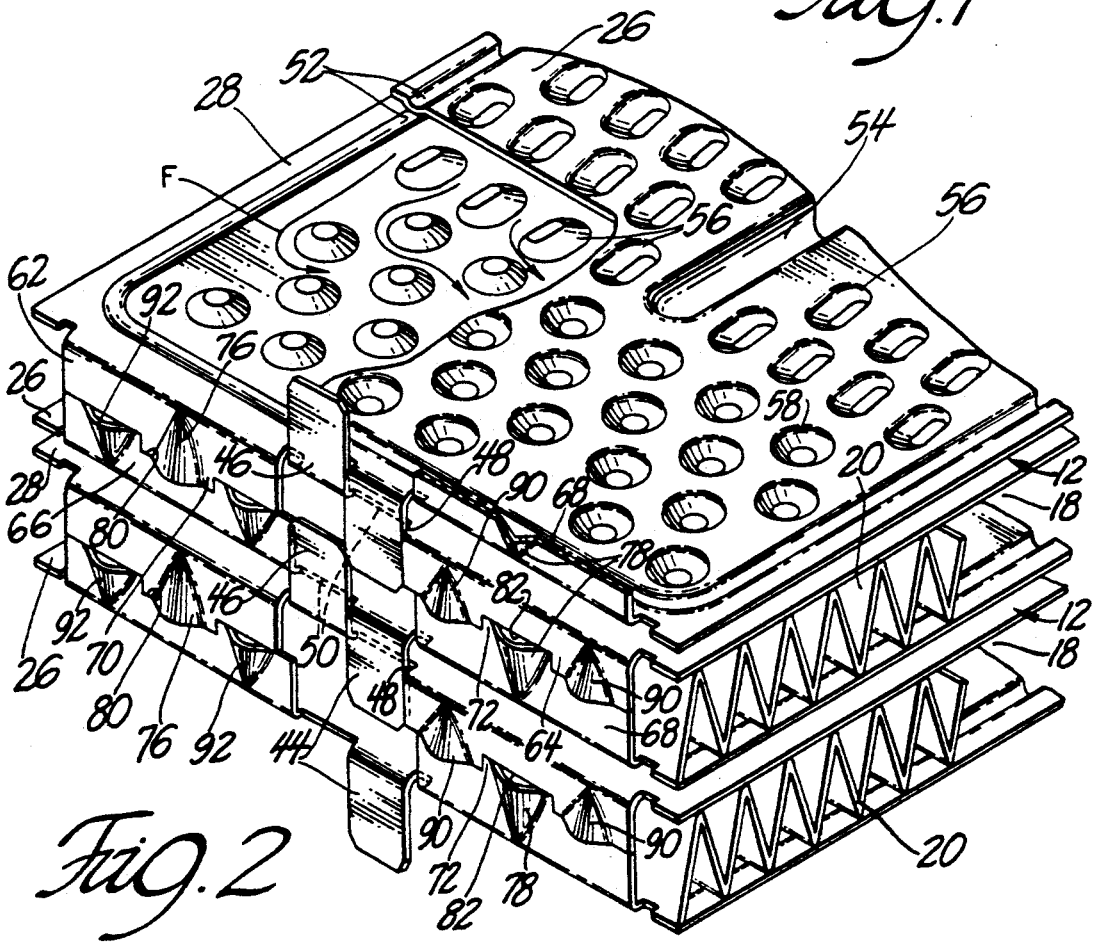
FIG. 2 is a pictorial view of a portion of the heat exchanger of FIG. 1 with portions broken away illustrating a preferred embodiment of this invention.

Turning now in greater detail to the drawings, there is shown in FIG. 1 a finned cross flow heat exchanger 10 in the form of an evaporator core for an automotive air conditioning system adapted to be mounted within a module in the engine or passenger compartment of an automotive vehicle. The heat exchanger 10 comprises a plurality of generally flattened fluid conducting tubes 12 that are hydraulically connected with one another to provide a serpentined flow path for the heat exchanger fluid supplied thereto by way of an intake pipe 14 operatively connected into a first of the tubes 12. After changing phases while flowing through the heat exchanger, the fluid is discharged from the last tube of the heat exchanger through a pipe 16 which can be operatively connected to the compressor of the air conditioning system not shown.

The separate tubes 12 are operatively connected in rank to define spaces 18 therebetween which accommodate corrugated air centers or fins 20. These air centers, fixed between the flattened body portions of adjacent tubes 12, are corrugated thin sheets of aluminum or other suitable metal and are relatively fragile components of the heat exchanger and, as well known in this art, operate to increase the heat transfer performance of a heat exchanger.

Flattened end plates 22, 24 define opposite ends of the heat exchanger 10, as shown in FIG. 1. Air centers 20 are also operatively disposed between the end plates and the first and last tubes of the heat exchanger.

In an automotive air conditioner evaporator, a cross flow of air generally forced therethrough by a blower through the air centers looses heat energy to the refrigerant circulating through the tubes which boils and vaporizes and is then discharged by pipe 16 to the compressor thereby effecting the cooling of the air in the interior of the automotive vehicle.

Each tube 12 is fabricated from a pair of mating plates 26 and 28 which are substantially identical to one another. Each plate 26 or 28 is a stamping which is substantially flat except that the upper end has a pair of side-by-side oval protuberances 30 and 32 adjacent the upper end, and spaced plate aligning, locking and tube spacing means at their lower ends, which will be later described. When the plates are stacked into tubes and the tubes are stacked into a core, the plates interconnect at the tank end by the shoulder 34 encompassing the opening 36 in protuberance 32 of one tube. This shoulder 34 closely fits in the opening 35 in protuberance 30 of the next adjacent tube so that the tubes are mechanically coupled and spaced at their upper ends. When the tubes are subsequently brazed together into a permanent configuration, they transmit heat exchanger fluid from the intake pipe to the outlet pipe through a serpentine path provided thereby. The interconnected protuberances define the tank portion 37 of the heat exchanger core.

Each plate 26, 28, which for description purposes is referenced as the top and bottom plate respectively, has an aligning and locking arm 44 or 46 which are respectively received in the aligning and locking slots 48, 50 of the bottom and top plates 28 and 26. As shown, the aligning and locking slots are formed in a lower end edge portion of the respective plates and are adjacent to the locking arms. In this construction, the top and bottom plates are spaced from each other by the inwardly extended boundary ribs 52 and centralized inwardly extended divider ribs 54 in the top and bottom plates which contact one another when the plates are interfaced with one another. The plates or tube halves are accurately aligned to form the tubes without use of alignment fixtures. The flow paths of the heat exchanger fluid in each tube is bounded by these ribs 52 and 54. The top and bottom plates further have depressions 56 and 58 which contact one another when the plates are interfaced and brazed together to provide physical means for creating turbulence and varying the flow path through the tubes to increase the heat exchanger efficiency of the core, as is well known in this art.

Figure 3:
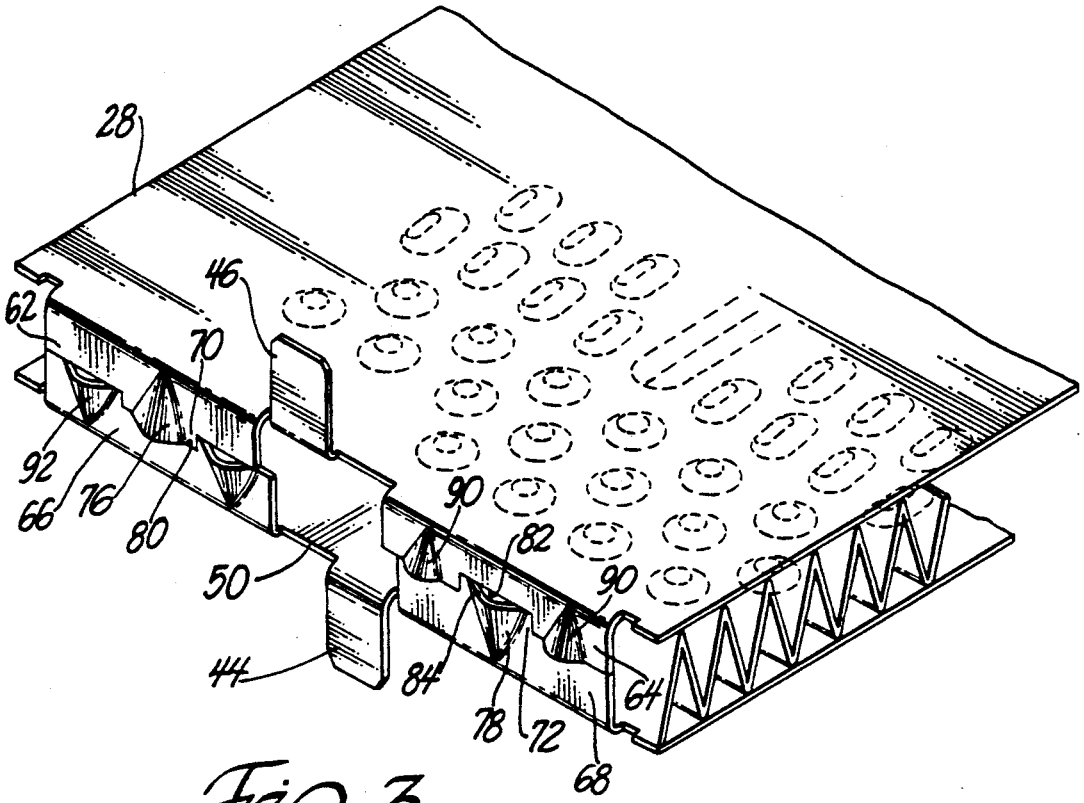
FIG. 3 is a pictorial end view of a portion of heat exchanger plates used in this invention.
Figure 4:
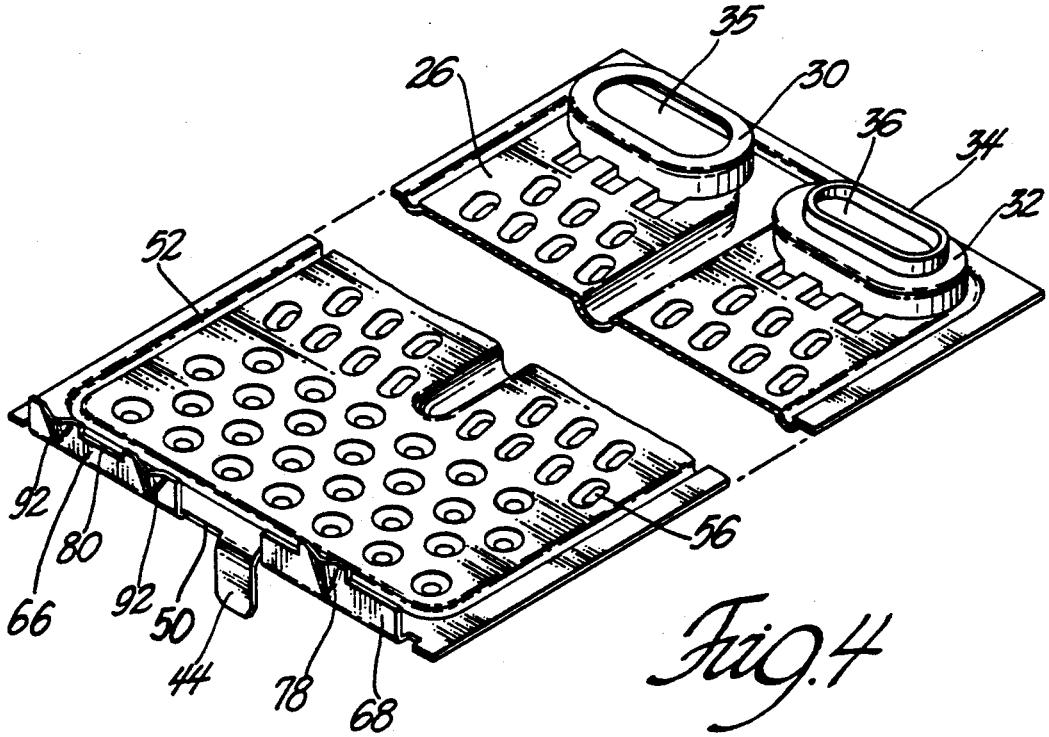
FIG. 4 is a pictorial view of one of the heat exchanger plates used in this invention.

In addition to the interconnecting, aligning and locking arms 44, 46 and their respective aligning and locking slots 48, 50, the bottom and top plates 28 and 26 respectively are formed with pairs of end flanges 62, 64 and 66, 68 bent outwardly from respective tubes to effect precise spacing of the tubes 12, as shown in FIG. 3. The flanges 62 and 68 of the bottom and top plate have locking tabs 70, 72 which extend in opposite directions with respect to the locking arms on the associated plates These tabs have semi-conical "eyebrow" like projections 76, 78 that ensure an appropriate fit into notches 80, 82 of adjoining plates when the tubes are interfitted and are spaced from one another.

Importantly, the triangular extension provided by the planar end face of the projection such as end face 84 of projection 78, best shown in FIG. 3, presents a wide contact surface for contacting the opposing contact face of notch 82. With this construction, the tabs 70 and 72 will contact the end face of the notches even when there is variation in the length of one plate of one tube relative to the mating plate of an adjacent tube. Accordingly, the top tube could be slightly longer or shorter than the bottom tube and still effective tube spacing and lower end support would be maintained. As shown, flanges 64 and 66 of the bottom and top plates have pairs of eyebrow type projections 90, 92 which similarly make contact with mating surfaces of flanges 62 and 64 of the plates of adjacent tubes for further column support and protection of the air centers.

With the present invention, the plates are precisely mechanically connected together to form tubes and the tubes are accurately aligned in rank when stacking into a core as provided by the tabs. When adjacent tube assemblies are stacked atop one another to construct a multi layer core, the aligned tabs and notches at either end of the tube assemblies interlock providing alignment in the horizontal direction so that no fixtures are needed for core alignment purposes.

When the tabs and notches are aligned in assembly, the integrally formed eyelids of the tabs bottom on the notches providing the proper tube to tube spacing, as required for optimized brazing. In addition, the eyelid enhances the strength of the tabs and also provides a widened area of contract providing for part-to-part assembly mismatch particularly in a lengthwise direction. The new tab/notch interlock system of this invention also provides for the improved retention of air centers at the end of the assembly, as well as reducing air leakage from the lower end.

Additionally, this invention provides a more economical use of material due to the minimum height of the tabs as compared to prior tube end design having overlapping or flanged end shapes, which require additional material to manufacture. With the tube halves assembly aligned with each other, as described, the bump patterns are set at appropriate angles. This "built in" alignment of the parts will be sufficient to insure the consistent and necessary contact of adjacent brazing surfaces to facilitate the proper brazing of stacked core plates into tubes without the requirement of any external alignment devices to facilitate the brazing process.

The serpentined flow around the centralized ribs in each tube from an inlet opening, such as opening 35, to an outlet opening, such as opening 36, is illustrated by flow arrows F.

While a preferred embodiment of the invention has been shown and described, other embodiments will now become apparent to those skilled in the art. Accordingly, this invention is not to be limited to that which is shown and described but by the following claims.

We claim:

1. A plurality of tubes for operative connection in a multi tube heat exchanger, each of said tubes comprising first and second plates of thin wall sheet material adapted to be operatively connected together in face-to-face alignment to have an inlet for admitting a heater exchanger fluid thereto and have an outlet for discharging said fluid therefrom after circulating through a path therein, each of said plates being elongated and having a body extending in a plane, each of said plates having protuberance means formed at one end thereof which extends in a general direction outward of the plane of said body to form portions of said fluid inlet and outlet and having laterally spaced flange means at the other end thereof which extends in the same direction as said protuberance means and interlocking projection and notch means formed in said flange means for spacing said tubes from one another subsequent to the connection of said plates into tubes, said projection and notch means having edge portions to contact one another without overlap of the plane of an adjacent plate of an adjacent tube, interlocking arm and slot means on said first and second plates of each tube for securing said first and second plates together, said arm means on said first plate extending through said slot means on said second plate and overlapping the plane there when forming a tube.

2. A tube for use in a multi tube heat exchanger comprising a pair of thin wall plates, each of said plates having a main body portion extending in a plane and having a centerline, protuberance means formed on one end of each said plate and extending in a direction generally perpendicular to the plane of said body portion to form a tank portion of said tube when said plates are mated and joined together to form said tube, a pair of laterally spaced main flanges formed on the other end of each said plate and extending in the same direction as said protuberance means one of said flanges defining main tab and tab notch means therebetween, the other of said flanges having a tab member, said tab and tab notch means being offset to one side of said centerline of said plate member, an alignment and locking arm and a locking arm slot formed side by side on said other end of each said plate and adjacent to said centerline, said locking arm of a first of said plates extending to overlap and fit in said locking arm slot of a second of said plates so that said pair of plate members are mated together in precise alignment to form a tube, said tab member and said tab notch means on plates of adjacent tubes engaging one another in a non-overlapping manner to provide connector means for spacing and interconnecting two adjacent tubes to one another.

3. Fluid flow tube means for connection in a multi tube heat exchanger, each said tube means comprising first and second plates of thin wall sheet material adapted to be operatively connected together to form a flattened unit having an inlet for admitting a heat exchanger fluid thereto and having an outlet for discharging said fluid therefrom after circulating through a path within said unit, each of said plates being elongated and having a main body portion extending in a plane, each of said plates having protuberance means formed at one end thereof which extends in a general direction outward of the plane of said body of said plate and having laterally spaced flange means at the other end of said plate which extends in the same direction as said protuberance means, a first set of said laterally spaced flange means defining a first set of interlocking means including a pair of laterally spaced tab means to define notch means having a contact edge therebetween, a second of said laterally spaced flange means having a tab member extending therefrom, said tab member of a plate of one tube being adapted to fit in said notch means of a plate of an adjacent tube in a non-overlapping manner so that adjacent tubes are in precisioned alignment with one another and are spaced a predetermined distance from one another, and said tab member having an offset edge to contact the edge of said receiving notch therefor, and a second set of interlocking means on each said plate comprising a locking arm and a locking arm slot adjacent to one another, said locking arm being adapted to overlap the plane of the facing plate and engage said locking arm slot therein to align and hold said first and second plates together when forming a tube.

4. A plurality of tubes for operative connection in a multi tube heat exchanger, each of said tubes comprising first and second plates of thin wall sheet material adapted to be paired and connected together in faced alignment to form a fluid flow passage having an inlet for admitting a heat exchanger fluid thereto and having an outlet for discharging said fluid therefrom after circulating through a path within said tube, each of said plates being elongated and having a generally planar body and having protuberance means at one end thereof which extends in a general direction outward of the plane of said body to define a portion of said inlet and outlet of each tube, each of said plates having first and second laterally spaced flange means at the other end thereof which extends in the same direction as said protuberance means, said first flange means having laterally spaced projection means extending therefrom to define notch means therebetween, said second flange means having a projecting portion extending outwardly therefrom, each of said plate having a locking arm located between the first and second flange means and extending in a direction opposite to the direction of extension of said first and second flange means, locking arm slot means formed in said plate adjacent to said locking arm means, said locking arm of a first plate being received in said slot means in a second plate to lock a pair of said first and second plates into a tube, said projecting portion of said second flange means being adapted to fit in a non-overlapping manner within said notch means of an adjacent plate of an adjacent tube to space adjacent tubes from one another.

* * * * *